United States Patent [19]

Kimura et al.

[11] Patent Number: 4,484,520

[45] Date of Patent: Nov. 27, 1984

[54] COMPACT PRINTER WITH CLUTCH

[75] Inventors: Takeshi Kimura; Satoshi Watanabe, both of Chichibu; Hirofumi Hirano, Arakawa; Setsuo Sasaki, Chichibu, all of Japan

[73] Assignee: Canon Kabushiki Kaisha, Tokyo, Japan

[21] Appl. No.: 515,664

[22] Filed: Jul. 20, 1983

Related U.S. Application Data

[63] Continuation of Ser. No. 285,399, Jul. 20, 1981, abandoned.

[30] Foreign Application Priority Data

Jul. 31, 1980 [JP] Japan ..... 55-104404

[51] Int. Cl.[3] ..... B41J 1/08

[52] U.S. Cl. ..... 101/99; 101/93.22

[58] Field of Search ..... 101/93.22, 95, 96, 99, 101/110, 111

[56] References Cited

U.S. PATENT DOCUMENTS

| | | | |
|---|---|---|---|
| 3,613,574 | 10/1971 | Longcoy | 101/110 X |
| 3,717,234 | 2/1973 | Koller | 101/110 X |
| 3,838,638 | 10/1974 | Clary | 101/99 X |
| 3,916,786 | 11/1975 | Clary | 101/93.22 X |
| 3,921,518 | 11/1975 | Carnes | 101/111 |
| 4,104,967 | 8/1978 | Okabe | 101/93.22 X |
| 4,122,770 | 10/1978 | Umeda et al. | 101/99 X |
| 4,161,912 | 7/1979 | Usui et al. | 101/93.22 X |
| 4,244,291 | 1/1981 | Kodaira et al. | 101/99 |
| 4,258,624 | 3/1981 | Mitsui | 101/93.22 |
| 4,276,824 | 7/1981 | Schottle | 101/93.22 X |

*Primary Examiner*—Edward M. Coven

*Attorney, Agent, or Firm*—Fitzpatrick, Cella, Harper & Scinto

[57] ABSTRACT

In a compact printer provided with a type wheel having a type belt wound on a cylindrically formed base, a hammer mechanism contained within the type wheel, and a DC motor for operating the type wheel and a paper feed mechanism, the rotational force from the DC motor is transmitted to the type wheel through a spring clutch mechanism and a code plate for generating a timing signal is provided on the side surface of the type wheel so that a solenoid for controlling the spring clutch mechanism is driven by the timing signal.

2 Claims, 11 Drawing Figures

COMPACT PRINTER WITH CLUTCH

This application is a continuation of application Ser. No. 285,399 filed July 20, 1981, now abandoned.

BACKGROUND OF THE INVENTION

1. Field of the Invention

This invention relates to a compact printer, and more particularly to a compact printer in which hammers are contained within a type wheel and the type wheel is stopped during printing to effect printing.

2. Description of the Prior Art

Printers of the type in which hammers are contained within a type wheel and the hammers impact the type wheel from therewithin to thereby effect printing are known. The printers of this type, unlike the conventional flying hammer type printers, have the advantage that the vibration of printing paper during printing is small and little noise is produced.

In the printers of such type, however, it is necessary to stop the type wheel during printing and therefore, as disclosed in Japanese patent publication No. 11226/1966, a servo motor or a pulse motor directly connected to the type wheel has been used as a drive source and driving or stopping of the type wheel has been effected by an instruction from a control circuit.

However, the adoption of such a construction has led to difficulty in making the printer compact because of the limited size of the servo motor or the pulse motor, and has also led to complexity of the control circuit which means high cost of manufacture, and such a construction has been unsuitable for inexpensive compact printers, for example, the printers of recording type desk top calculators.

SUMMARY OF THE INVENTION

It is an object of the present invention to provide a compact printer which is simple in construction and which can be manufactured at low cost.

It is another object of the present invention to provide a compact printer in which means for stopping and driving the type wheel is constituted by a compact and inexpensive mechanism.

It is still another object of the present invention to provide a compact printer in which paper feed means for feeding printing paper can be driven without using an electrical signal from the control circuit side.

It is yet still another object of the present invention to provide a compact printer in which the type wheel has been made into a necessary minimum size.

It is a further object of the present invention to provide a compact and inexpensive printer in which the control circuit is simplified and consumption of power is small.

The invention will become fully apparent from the following detailed description thereof taken in conjunction with the accompanying drawings.

BRIEF DESCRIPTION OF THE DRAWINGS

FIG. 1-(B) is a longitudinal cross-sectional side view of a spring clutch.

DESCRIPTION OF THE PREFERRED EMBODIMENTS

Figure 4:
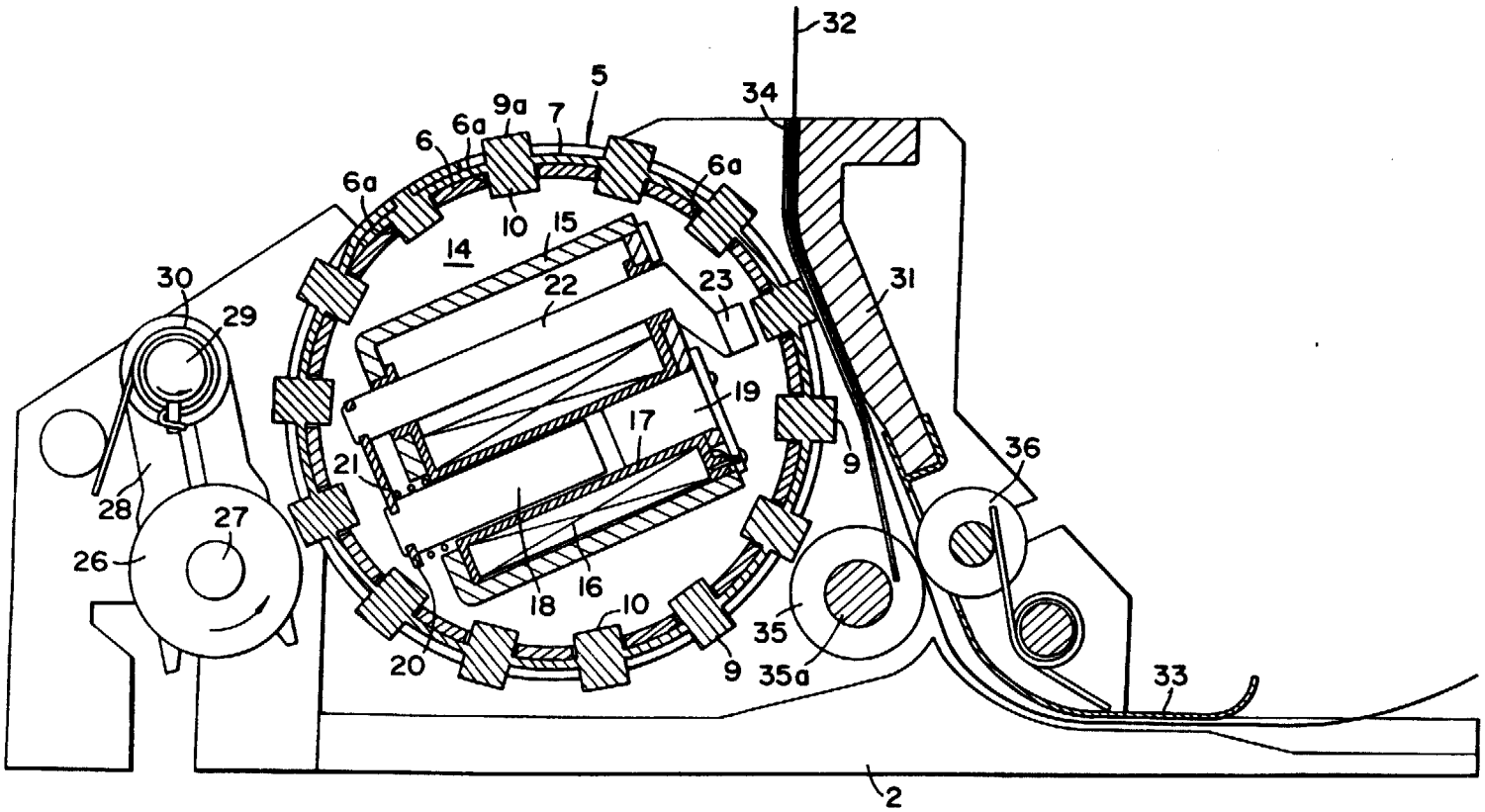
FIG. 4 is a vertical cross-sectional side view of a type wheel.

Referring to FIG. 1 which is an exploded perspective view of an illustrative embodiment of the present invention, a printer generally designated by reference numeral 1 is assembled with a frame 4 as a basis, the frame 4 having opposite side plates 2 and 3. A type wheel 5 is rotatably journalled between the side plates 2 and 3 of the frame 4. The type wheel 5, as shown in FIG. 4, has a cylindrically formed base 6 and a type belt 7 is fitted over the outer peripheral surface of the base 6.

Figure 2:
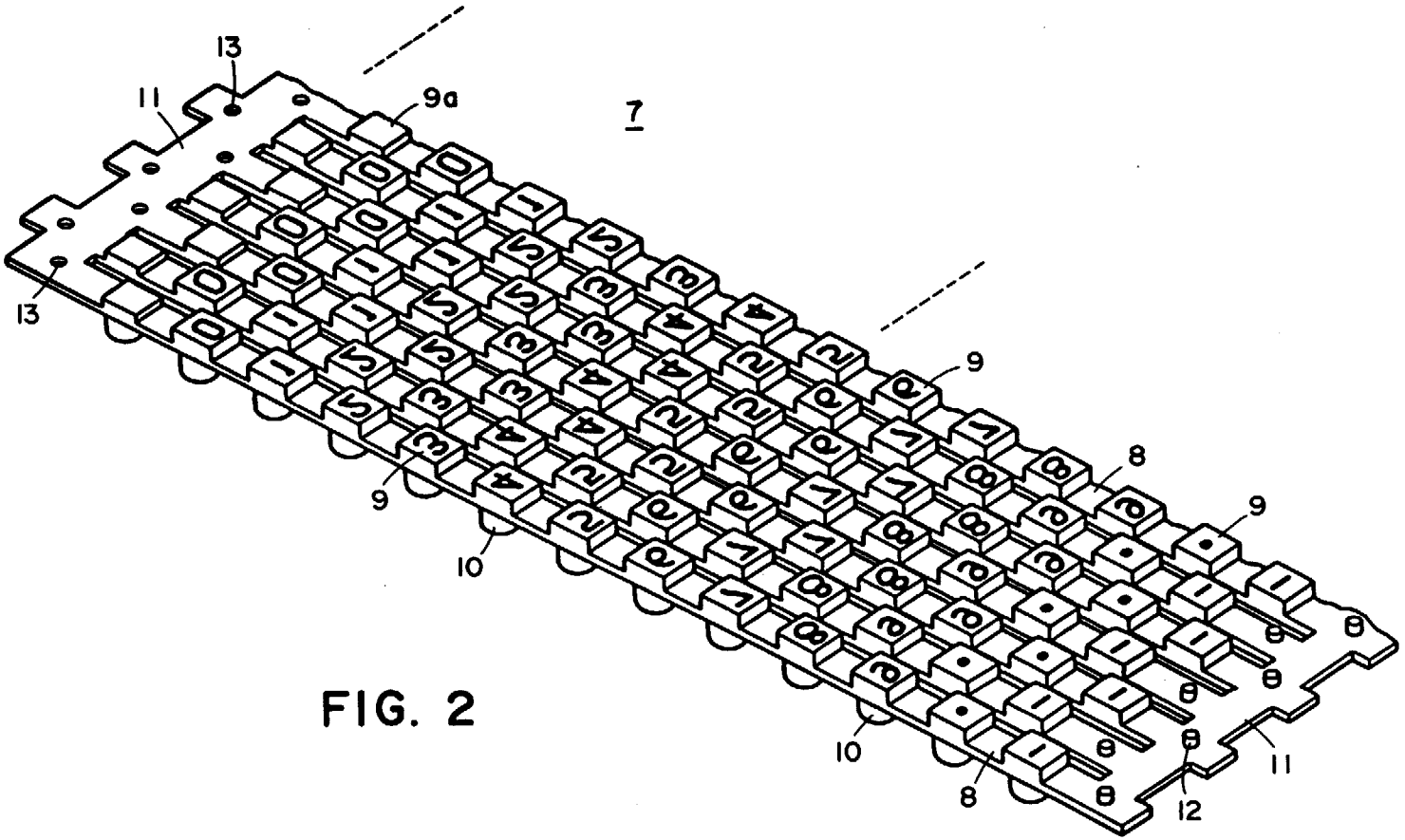
FIG. 2 is a perspective view of a type belt.
Figure 3:
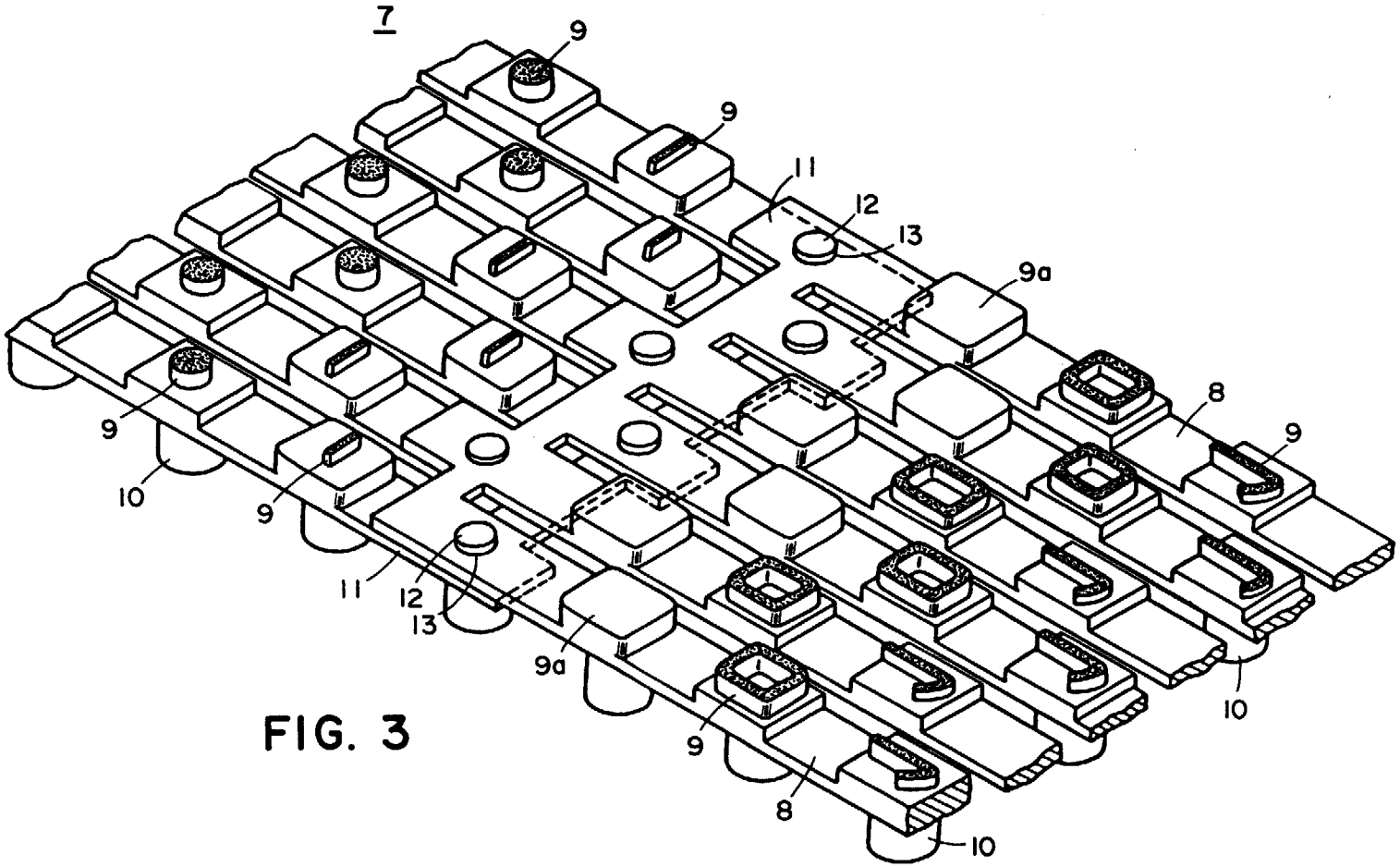
FIG. 3 is an enlarged perspective view of the connecting portion of the type belt.

The type belt 7, as shown in FIGS. 2 and 3, for example, has a plurality of independent belt segments 8 each of which has twelve type portions 9 such as "0"–"9" and "." and "-" on the upper surface thereof and further has a dummy type portion 9*a* which is a non-type portion. As can be seen in FIG. 2, the type portions 9 and dummy type portion 9*a* are arranged such that odd-number rows and even-number rows of the belt segments 8 are in staggered relation. Projections 10 corresponding to the respective type portions are formed on the reverse side of each belt segment 8 and, as shown in the cross-sectional view of FIG. 4, these projections 10 are slidably fitted in through-apertures 6*a* formed in the base 6.

The opposite ends of each belt segment 8 are integrally connected together through connecting portions 11. On the surface of one of the connecting portions 11, short pillar-like projections 12 which are non-type portions and which have the same height as the type portions 9 are formed at the same pitch as the type portions 9, and in the other connecting portion 11, there are formed through-apertures 13 into which the projections 12 are fitted.

The type belt 7 having such a construction is wound on the outer periphery of the base 6 and is integrally connected with the projections 12 being fitted in the through-apertures 13. Such condition is shown in FIG. 3.

Figures 1A, 1B:
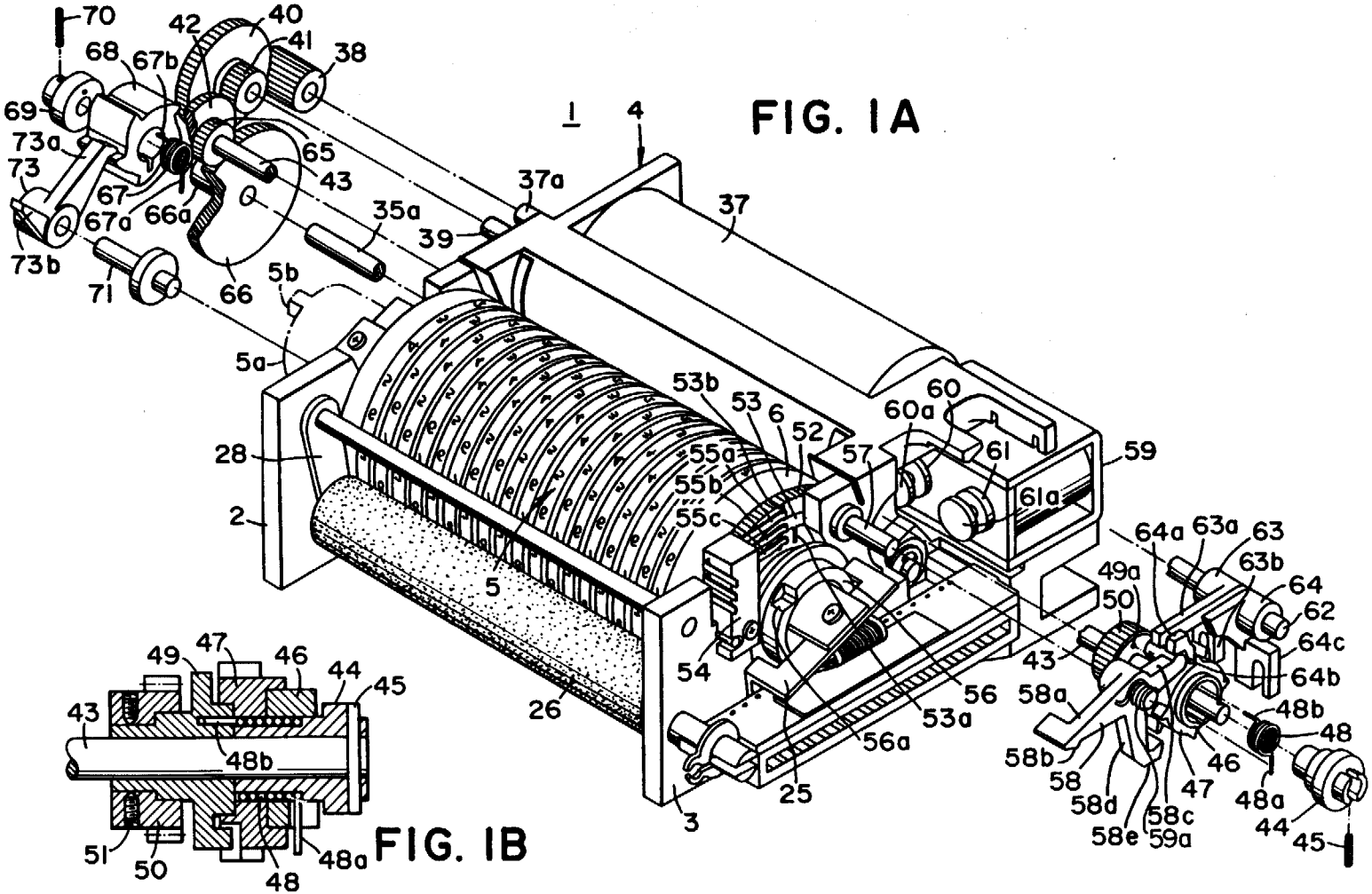
FIG. 1-(A) is an exploded perspective view of an embodiment of the present invention.

The type wheel having the above-described construction is capable of printing eighteen columns as shown in FIG. 1(A). Hammer units 14 as shown in FIG. 4 are contained within the type wheel 5. The number of the hammer units is one half of the printed columns, i.e., nine, so that printing of two columns is effected by one hammer. This method can render the entire printing apparatus compact and light in weight and also results in reduced cost.

Each of the hammer units 14 has a yoke 15 within which a cylindrical coil 16 is contained. A rod 18 is slidably fitted in the bobbin 17 of the coil 16. The inner end of the rod 18 is opposed to a stopper 19 fixed to the yoke 15. The outer end of the rod 18 is fixed to one end of a bracket 20, and a spring 21 is resiliently mounted between the bracket 20 and the side edge of the bobbin 17.

Figure 5:
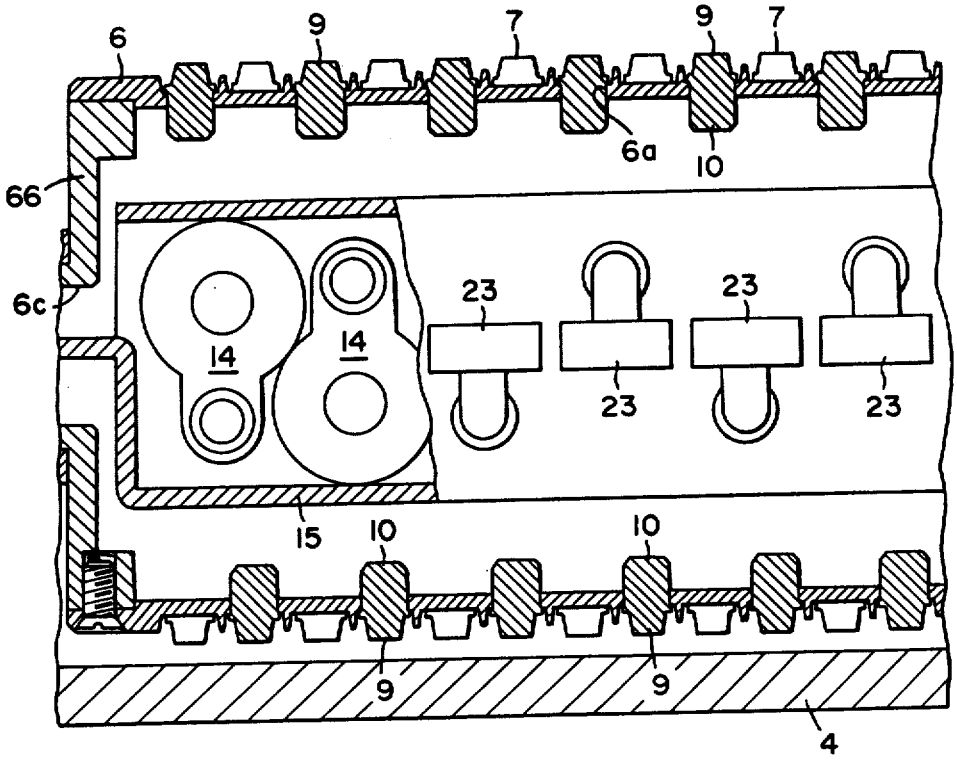
FIG. 5 is a vertical cross-sectional front view of the type wheel.

One end of a hammer rod 22 is fixed to the other end of the bracket 20. The hammer rod 22 is parallel to the rod 18 and is fitted slidably relative to the yoke 15, the other end of the hammer rod 22 being bent so as to face the vicinity of the reverse side of the base 6, and the foremost end portion thereof provides a hammer 23. As can be seen in FIG. 5, this hammer 23 is formed long in the horizontal direction and extends over two odd-number and even-number rows of the type belt so that a single hammer can impact two rows of type. Accordingly, adjacent types on the type belt are arranged in staggered relation. It will be appreciated that design may be made such that a single hammer can impact three or four rows of type.

As shown in FIG. 5, these hammer units 14 are held within the base 6 by the yoke 15, and further, the opposite ends of the yoke 15 face outwardly through an opening 6c formed in the center of the end plate 6b of the base 6 rotatably journalled to the side plates 2 and 3 of the frame 4, and are secured to the side plates 2 and 3 through metal fittings 25 (FIG. 1).

On one side of the type wheel 5 having the above-described construction, an ink roller 26 is disposed parallel to the type wheel. The opposite ends of the rotary shaft 27 of this ink roller 26 are rotatably journalled to a bracket 28, the upper end of which is rotatably journalled to a support shaft 29 projectedly formed on the side plates 2 and 3. The ink roller 26 is normally urged against the type belt 7 by a torsion coil spring 30 wound around the support shaft 29.

On the oppose side of the type wheel 5 from the ink roller 26, a platen 31 is disposed so as to extend between the side plates 2 and 3. Printing paper 32 is directed into between the platen 31 and the type wheel 5, and the printing paper 32 is guided between paper guides 33 and 34 and fed at a predetermined pitch by a paper feed roller 35 and a pinch roller 36 urged thereagainst, as will hereinafter be described.

As shown in FIG. 1, a DC motor 37 is mounted on the outside of the platen 31. A gear 38 is fixed to the output shaft 37a of the DC motor 37 and this gear 38 is in mesh engagement with an intermediate gear 40 rotatably journalled to the side surface of the side plate 2 through a support shaft 39. A gear 41 integral with the gear 40 is in mesh engagement with a gear 42 which is fixed to one end of a rotary shaft 43. The other end of the rotary shaft 43 extends through the side plates 2, 3 of the frame 4 to the other side of the frame, and a disc 44 is secured to that end by means of a pin 45. As shown in FIG. 1-(B), a ratchet disc 46 is rotatably fitted to the disc 44 and this ratchet disc 46 is forced into a ratchet wheel 47 in such a manner that the circumferential angle thereof is adjustable, and the ratchet disc 46 and the ratchet wheel 47 are normally rotatable together. The teeth of the ratchet wheel 47 are arranged in two staggered rows and at a predetermined pitch.

The ratchet wheel 47 contains therewithin the rotary shaft 43 and disc 44, and a coil spring 48 constituting a spring clutch is wound on the shaft portion of the disc 44. One end of the coil spring 48 provides an input end 48a fixed to the disc 44 side and the other end of the coil spring 48 which provides an output end 48b is fitted in a small hole 49a in a collar 49 rotatably fitted on the rotary shaft 43. A gear 50 is fitted on the shaft portion of the collar 49 and fixed to the collar 49 by a screw 51. This gear 50 is in mesh engagement with a gear 52 of a large diameter fixed to the side surface of the base 6 of the type wheel 5, and a conductive pattern 53 forming a code plate is annularly formed on the outer side surface of the gear 52. This conductive pattern has inside thereof a number of contacts 53a at positions corresponding to the type portions of even-number columns of the type belt and outside thereof a number of contacts 53b corresponding to the type portions of odd-number columns of the type wheel.

A strut 54 is fixed to a portion of the side plate 3 which is adjacent to that side on which the conductive pattern 53 is formed, and three contact pieces 55a–55c in the form of plate springs are disposed vertically parallel to one another with one end of each of the contact pieces being secured to the strut 54. The tip end of the contact piece 55a faces a position in which it contacts the contact piece 53b corresponding to the type portion of an odd-number column, the tip end of the contact piece 55b is normally in contact with the annular conductive pattern 53 forming a common electrode, and the tip end of the contact piece 55c faces a position in which it can contact the contact 53a corresponding to the type portion of an even-number column.

A boss 56 is projectedly provided on that end portion of the base 6 of the type wheel 5 on which the gear 52 is provided, and a cam groove 56a is formed in a portion of the peripheral surface of the boss 56. One end of a stop lever to be described which is a follower lever is fitted in the cam groove 56a.

A stop lever 58 is rotatably supported on a support shaft 57 projectedly provided on the side surface of the side plate 3 and is biased for counter-clockwise rotation as viewed in FIG. 1-(A) by a spring, 59a. The stop lever 58 is substantially of T-shape, and a protruded portion 58b fitted in the cam groove 56a is formed in the underside of the end of one arm 58a of the stop lever 58 which extends horizontally, and the end of the other arm 58c faces above the ratchet wheel 47. This stop lever 58 is normally biased into contact with a cam portion formed in the boss of the type wheel, by a spring, not shown. Thus, the stop lever 58 rotates following the cam portion. A hook 58e formed at the end of the downwardly and substantially vertically extending arm 58d of the stop lever 58 can restrain the ratchet wheel 47.

On the other hand, on a portion of the side plate 3, a solenoid 60 for stopping even-number columns and a solenoid 61 for stopping odd-number columns are provided horizontally in juxtaposed relationship and are supported by a support frame 59, and discs 60a and 61a are secured to the end of the respective rods of the solenoids. A support shaft 62 is projectedly provided horizontally on the side surface of the side plate 3 above the support frame 59, and a solenoid lever 63 for even-number columns and a solenoid lever 64 for odd-number columns are rotatably supported on the support shaft 62. Each of the solenoid levers 63 and 64 is generally L-shaped, and the horizontally extending protruded portion 63a of the solenoid lever 63 has its end engaged with the upper side of the arm 58c of the stop lever 58 and is in a position in which it can restrain the toothed portion of the ratchet wheel 47 by a pawl portion near the end, not shown. A vertically extending protruded portion 63b is bifurcated downwardly and the rod of the solenoid 60 is fitted in the bifurcation. The horizontally extending protruded portion 64a of another solenoid lever 64 has its end likewise engaged with the upper side of the arm 58c of the stop lever 58, and a pawl portion 64b formed near the end is in a position in which it can restrain the toothed portion of the ratchet wheel 47. The vertically extending protruded portion 64c of the solenoid lever 64 is bifurcated downward and the rod of the solenoid 61 is fitted in the bifurcation.

On the other hand, a gear 65 of a small diameter integral with the gear 42 is fixed to the rotary shaft 43 and this gear 65 is in mesh engagement with a gear 66 of a large diameter, to which is rotatably fitted the rotary shaft 35*a* of the paper feed roller 35.

A coil spring 67 is wound on the boss 66*a* of the gear 66, and a paper feed ratchet 68 is rotatably fitted outside of the coil spring 67. A disk 69 is secured to the end of the rotary shaft 35*a* by means of a pin 70. An input end 67*a* which is one end of the coil spring 67 is secured to the paper feed ratchet 68 and an output end 67*b* which is the other end of the coil spring 67 is secured to the disc 69. What has been described above constitutes a paper feeding spring clutch mechanism.

A ratchet lever 73 is rotatably supported on a support shaft 71 projectedly provided on the side surface of the side plate 2 and the end 73*a* of the ratchet lever 73 is biased for rotation in a direction to engage the paper feed ratchet 68, by a spring, not shown. A projection 5*b* projectedly provided on the rotary cylinder 5*a* of the type wheel 5 faces the underside of the ratchet lever 73 and, when the projection 5*b* downwardly depresses the arm 73*b* of the ratchet lever 73, the end 73*a* becomes disengaged from the paper feed ratchet 68.

Operation of the printer of the present embodiment constructed as described above will now be described by reference to the timing chart of FIG. 6.

When a print instruction comes from a control circuit as hereinafter described, power supply to the motor 37 is started. The rotation of the motor 37 is transmitted through its output shaft 37*a* to the rotary shaft 43 by the gears 38, 40, 41 and 42. The rotation of the rotary shaft 43 in turn is transmitted through the gear 50 to the gear 52 of the type wheel 5, but at this time the projection 58*b* formed at the end of the arm 58*a* of the stop lever 58 is fitted in the cam groove 56*a* of the boss 56 and further, the stop lever 58 is biased for rotation in counterclockwise rotation as viewed in FIG. 1 by a spring not shown and therefore, the hook 58*e* at the end of the vertically extending arm 58*d* of the stop lever 58 restrains the toothed portion of the ratchet wheel 47, and thus the ratchet wheel 47 is restrained from rotation. Accordingly, when the rotary shaft 43 is rotated in a predetermined direction, the coil spring 48 flexes in a direction in which it is unwound, to liberate the disc 44, because the input end 48*a* of the coil spring 48 is fixed to the ratchet disc 46 side. Thus, the spring clutch mechanism with the coil spring 48 as the force transmitting means assumes OFF condition, so that the gear 50 is not rotated and the rotation of the rotary shaft 43 is not transmitted to the gear 52 of the type wheel 5.

In this condition, when power is supplied to the odd-number column stopping solenoid 61 and the even-number column stopping solenoid 60 simultaneously after time $T_1$, the protruded portions 63*a* and 64*a* of the solenoid levers 63 and 64 which have so far been rotated in a clockwise direction away from the ratchet wheel 47 as viewed in FIG. 1-(A) are rotated toward the ratchet wheel 47 and the protruded portion 64*a* of the solenoid lever 64 downwardly depresses the arm 58*c* of the stop lever 58 against the force of the spring. As a result, the engagement between the hook 58*e* of the stop lever 58 and the ratchet wheel 47 is broken and the ratchet wheel 47 is released from restraint. Thus, the input end 48*a* of the coil spring 48 which has so far been restrained also becomes free and the coil spring 48 twines around the shaft portion of the disc 44. Accordingly, the rotational force through the disc 44 is transmitted to the gear 50 through the collar 49, thereby rotating the type wheel 5 through the gear 52.

As the type wheel 5 is rotated, the boss 56 is also rotated and the projection 58*b* of the arm 58*a* of the stop lever 58 is pushed out of the cam groove 56*a*, so that even if the power supply to the solenoids 60 and 61 is cut off, the stop lever 58 will not return to its original position and the hook 58*e* will not restrain the ratchet wheel 47.

Accordingly, when the power supply to the solenoids 60 and 61 is cut off, the solenoid lever 64 is rotated in a clockwise direction as viewed in FIG. 1-(A) by a spring, not shown, and the projection 64*b* becomes spaced apart from the ratchet wheel 47 and the spring clutch becomes ON. Thereafter, if no power is supplied to the solenoids 60 and 61, the hook 58*e* of the stop lever 58 does not engage the ratchet wheel 47, and thus the type wheel 5 continuously effects one full rotation. In the meantime, the type wheel 5 and the ratchet wheel 47 rotate in synchronism with each other and the conductive pattern 53 constituting a code plate also rotates synchronously and therefore, two types of signals, i.e., odd-number timing signal S and even-number timing signal R, are taken out by virtue of the cooperation between the contact pieces 55*a*–55*c* and the conductive pattern 53.

Figure 6:
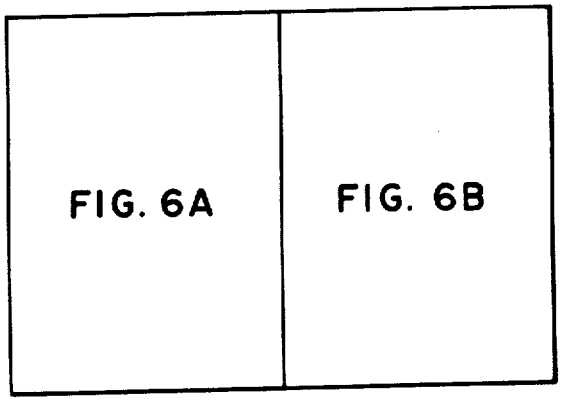
FIG. 6 shows an arrangement of FIGS. 6A and 6B, and FIGS. 6A and 6B show a composite timing chart arranged in accordance with FIG. 6.
Figure 6A:
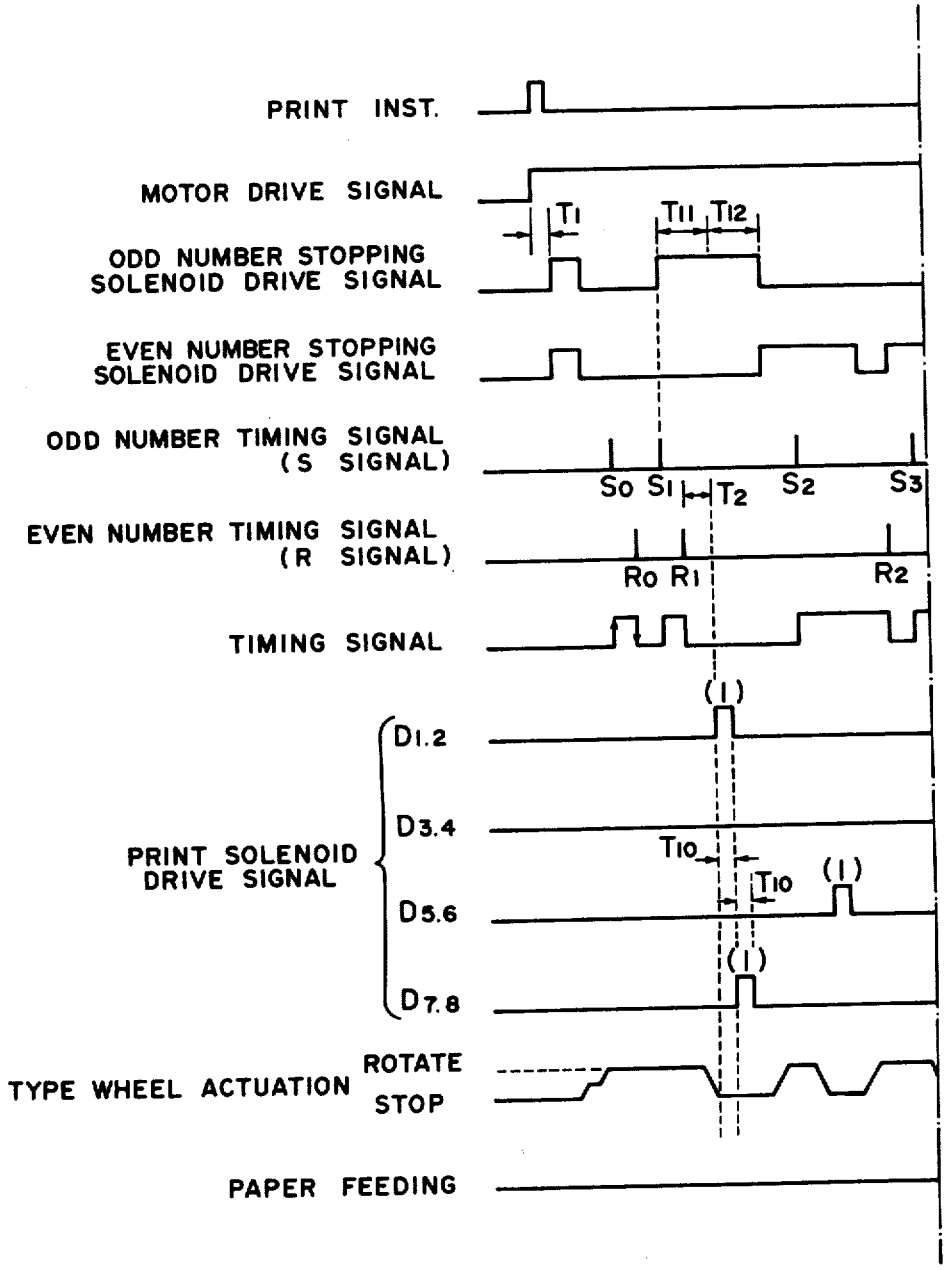
Figure 6B:
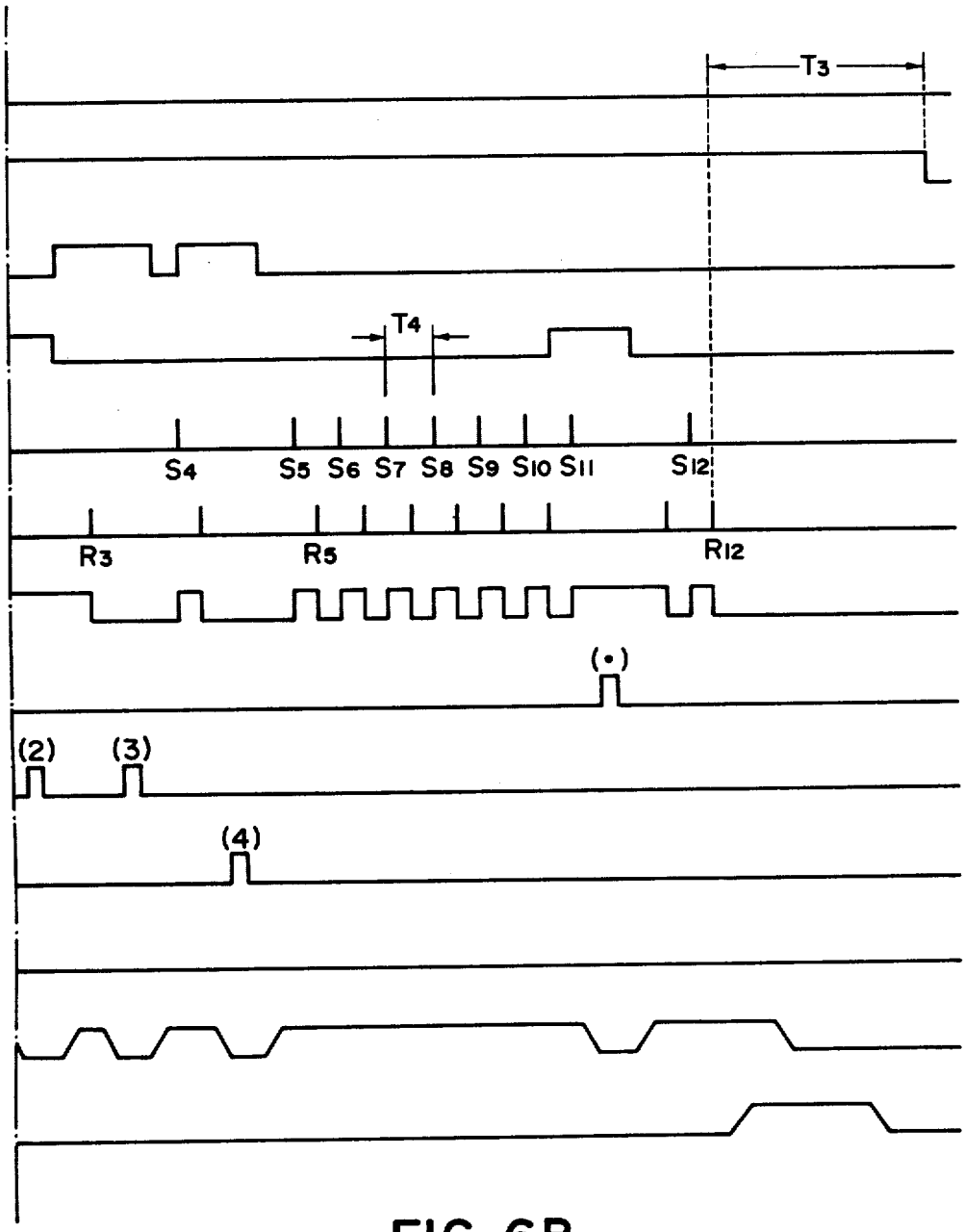

When it is desired to print the second character of odd-number columns, namely, number "1", power is supplied to the odd-number column stopping solenoid 61 by an odd-number timing signal $S_1$, as shown in FIG. 6, whereupon the solenoid lever 64 is rotated as previously described and the projection 64*b* thereof comes into engagement with the ratchet wheel 47 and the spring clutch becomes OFF, thus stopping rotation of the type wheel 5. In this condition, power is supplied to the coil 16 of the hammer of the necessary column to cause the hammer 23 to advance, thereby effecting printing. For example, where printing of "11423.1" is to be effected, hammer units $D_{1,2}$ and $D_{7,8}$ are driven in FIG. 6 to print "1".

Now, design is made such that the drive signal for the solenoids 60 and 61 is generated with a time delay $T_1$ after the motor driving signal has been produced, and this is because if an inexpensive motor of a relatively large diameter is used as the motor 37, the rising time until the motor assumes a predetermined rotational speed is long and therefore, if time $T_1$ is 0, it is difficult to predetermine time $T_2$ until the print solenoid driving signal of the hammer unit is produced, in the vicinity of the point whereat $S_0$ and $S_1$ of signal S and $R_0$ and $R_1$ of signal R which are the initial signals of the rotation of the motor are generated. Therefore, in the present invention, time $T_1$ is set in accordance with the motor used and $T_1$ is determined within the range in which the time $T_2$ until the printing hammer is actuated is determined, and by so setting the time $T_1$, the selection range of the motor used can be widened.

In addition, even if the motor remains supplied with power after one printing cycle has been terminated, no operation of the mechanism will take place and another printing cycle will not be started until the solenoids 60 and 61 are driven and this eliminates the necessity of stopping the motor by a brake as has heretofore been done in the start/stop type printer which adopts the system whereby one printing cycle is mechanically determined, and also eliminates the necessity of providing a complicated circuit and ensures that the entire mechanism stays at a predetermined position even if the motor overruns.

Also, during printing, the solenoid 60 or 61 is energized, but once the solenoid levers 63 and 64 have come into engagement with the ratchet wheel 47, the engagement can be maintained with a small force by the rotational force of the ratchet wheel 47 and the friction force of the contacting portion. Accordingly, at the initial stage of power supply indicated by $T_{11}$ in FIG. 6, a predetermined power is necessary, but after the engagement indicated by $T_{12}$, the power can be reduced to $\frac{1}{3}$ or less and therefore, if the output power is changed over by the commonly used two-powersource system, the load of the power source can be further reduced.

Where the same number of an odd-number column or an even-number column is to be printed, as shown in FIG. 6, power is not supplied to the coils of the printing solenoids at one time and time-division drive is effected while being shifted by the width $T_{10}$ of the drive signal, and this is particularly effective in a printer using dry element batteries. That is, where a printer is driven by dry element batteries, a great current cannot be secured because of the internal impedance of the dry element batteries and, where nine printing hammers each requiring consumed power of 300 mA are employed, it is sometimes the case that $9\times0.3A=2.7A$ is momentarily required. However, if time-division drive is effected in this manner, consumption of the power can be remarkably reduced.

Now, an odd-number column stopping solenoid driver signal is generated by an odd-number timing signal $S_1$, and this signal $S_1$provides the set input of a flip-flop connected to the prestage of the counter of a control circuit which will hereinafter be described. However, as is apparent from the timing chart of FIG. 6, the type wheel is rotating in the meantime and picks up an even-number timing signal $R_1$ also. This signal $R_1$ provides the reset input of the aforementioned flip-flop, but since the solenoid driving signal is set so as to be put out for a predetermined time, the even-number column stopping solenoid driving signal by the signal $R_1$ is not generated until a predetermined time elapses. In the meantime, the type wheel 5 is stopped and printing solenoid driving signals $D_{1,2}$ and $D_{7,8}$ are generated to effect printing on a selected odd-number column.

Thereafter, operation is repeated in a similar procedure a necessary number of times and the last character "." is printed, whereafter if power is not supplied to the solenoids 60 and 61, no timing signal is produced with the timing signal $R_{12}$ as the last one.

At this time, all of the characters on the type wheel to be printed are printed and the type wheel comes to its original position with the projection **58*b* of the stop lever 58 fitted in the cam groove 56*a***, and thus the type wheel stops.

On the other hand, when the last character has been printed, in FIG. 1-(A), the projection **5*b* projectedly provided on the rotary cylinder 5*a* of the type wheel 5 comes into contact with the arm 73*b* of the ratchet lever 73 and rotates it counter-clockwise against the force of a spring, not shown, so that the engagement between the paper feed ratchet 68 and the ratchet lever 73 is released. Thereupon, the paper feed ratchet 68 becomes free and the coil spring 67 twines around the boss 66*a* of the gear 66, whereby the rotary shaft 35*a* of the paper feed roller 35 and the gear 66 become integral with each other through the disc 69, so that the rotational force of the motor 37 is transmitted through the gear 66 to rotate the paper feed roller 35** through a predetermined angle.

At a point of time whereat the protruded portion **5*b* has engaged the ratchet lever 73, the protruded portion 58*b* of the stop lever 58 is fitted in the cam groove 56*a*, so that the type wheel is stopped. At this time, the next pawl portion of the paper feed ratchet 68 is not yet engaged with the ratchet lever 73 but will be engaged therewith only after the paper feed ratchet 68 has been rotated for a time necessary for paper feed, whereupon the paper feeding operation will be terminated. That is, paper feed begins after the even-number timing signal $R_{12}$ on the type wheel 5 has been produced, and the paper feeding operation is continued even after the rotation of the type wheel has been stopped. This time is predetermined by the number of revolutions of the motor 37, the numbers of teeth of the gears 38, 40–42, 65, 66, and the number of pawls of the paper feed ratchet 68. As shown in FIG. 6**, termination of the printing operation for one line takes place in time $T_3$ after the even-number timing signal $R_{12}$ has been produced, and that time is sufficiently greater than the interval $T_4$ of the odd-number or even-number timing signal S or R, so that the termination of printing can be known on the control circuit side and the rotation of the motor can be stopped after lapse of time $T_3$.

Now, as previously described, there are thirteen odd-number columns and thirteen even-number columns in the type portion of the type belt 7 and there is respectively one dummy portion which does not effect printing and there is respectively one connecting projection 12. When the type wheel 5 is stopped by the stop lever 58, the print position lies substantially intermediate the dummy type portion and the projection. The type wheel starts to rotate in this condition and when the dummy type portion of the next odd-number column has come to the print position, an odd-number timing signal $S_0$ is produced by the contact between the contact piece **55*c* and the contact 53*a* and this provides the first odd-number column stopping signal, and at a position corresponding to the dummy type portion of the next even-number column, the contact piece 55*a* comes into contact with the contact 53*b*, whereupon the first even-number column stopping signal $R_0$ is produced. However, when the last connecting projection 12** has come to the print position, no timing signal is produced but the feeding of the printing paper is effected.

The reason why design is made such that the paper feeding operation is not effected by a timing signal is that when the type wheel 5 is rotated, it is easy to move one line of the type portion in a time corresponding to $(T_4\div2)$ in FIG. 6, for example, 10 ms, whereas where the paper feeding operation is effected by two lines of the aforementioned projections, the paper feeding time is 20 ms. That is, even if use is made of a motor which can be driven in 20 ms, when the printing paper is fed too fast, the printing paper tends to jam and further, it becomes difficult to drive the printing paper by a small motor. Therefore, in the present invention, a paper feeding mechanism using a spring clutch is provided, whereby as previously described, the printing paper can be fed while a necessary paper feeding time is secured and moreover, the number of projections of the type wheel can be minimized. Accordingly, the type wheel never rotates at the point of time whereat paper feeding takes place and the diameter of the type wheel can be reduced to a necessary minimum.

Also, where odd-number and even-number timing signals are not produced in a certain time even if the motor 37 is driven, there is no particular necessity of providing a home position detecting signal if it is automatically discriminated that the type wheel is at its home position.

In the present invention, the stop lever 58 is operated at the time of start by the use of two solenoids 60 and 61, whereas if an attempt is made to accomplish this by the use of a single solenoid, a force twice as great will be required and a current twice as great as that during the ordinary printing will become necessary for the solenoid. Further, where a single power source is employed, a current twice as great will also become necessary during printing and when characters to be printed differ, power is almost always supplied to the stop solenoid, thus resulting in the heating thereof. It is for this reason that the present invention employs two solenoids, but if there is an allowance in the heating and power of the solenoids, design may be made such that operation is effected by a single solenoid.

Although the hammer 23 is disposed so as to be astride of two columns, it may also be astride of more than two columns or it may be made into a one-column hammer and the driving of the hammer may be done by a cam or the like without using a solenoid as the drive source.

Figure 7:
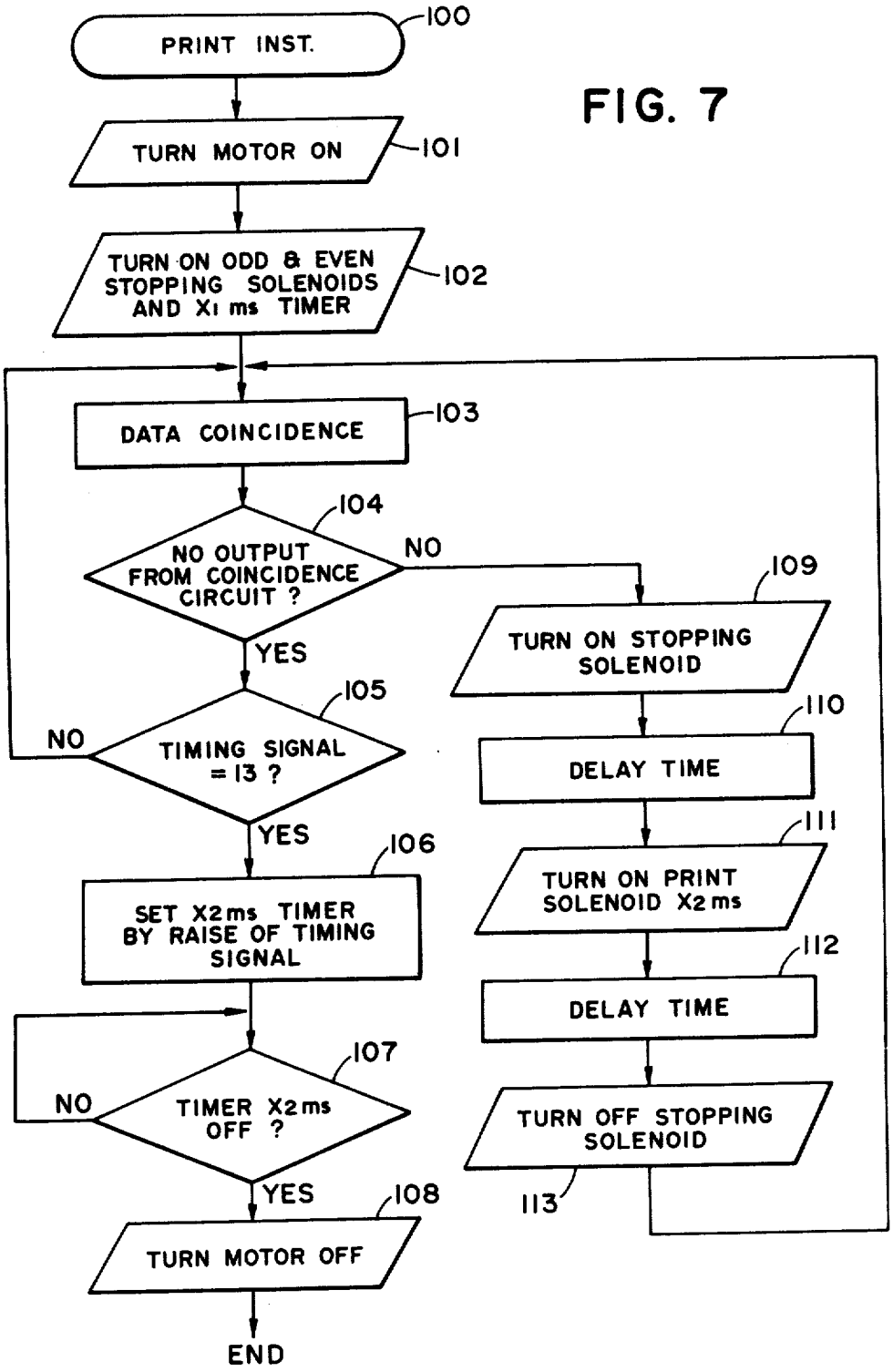
FIG. 7 is a flow chart.

FIG. 7 is a flow chart illustrating the printing operation. When a print instruction 100 comes, the motor 37 becomes ON (101) and the stopping solenoids 60 and 61 become $X_1$ ms ON at a time (102), and in this condition, coincidence between the data to be printed in a coincidence circuit is taken in a control circuit which will hereinafter be described (103), and the presence or absence of the output from the coincidence circuit is determined and in the case of no output (YES), timing signals are counted by 105 and whether a predetermined number of timing signals has been produced is determined and in the case of YES, $X_2$ ms timer is set so that there is a predetermined time delay after the falling of the timing signal (106), and whether the $X_2$ ms timer is OFF is determined by 107 and if it is OFF, the motor is stopped (108), thus terminating the printing operation.

If there is the output from the coincidence circuit at 104, the stopping solenoid is turned on (109), whereafter after lapse of a predetermined delay time (110), the printing solenoid becomes $X_3$ ms ON (111) and further, after lapse of a predetermined time (112), the stopping solenoid is turned off (113), and coincidence between data by 103 is taken.

Figure 8:
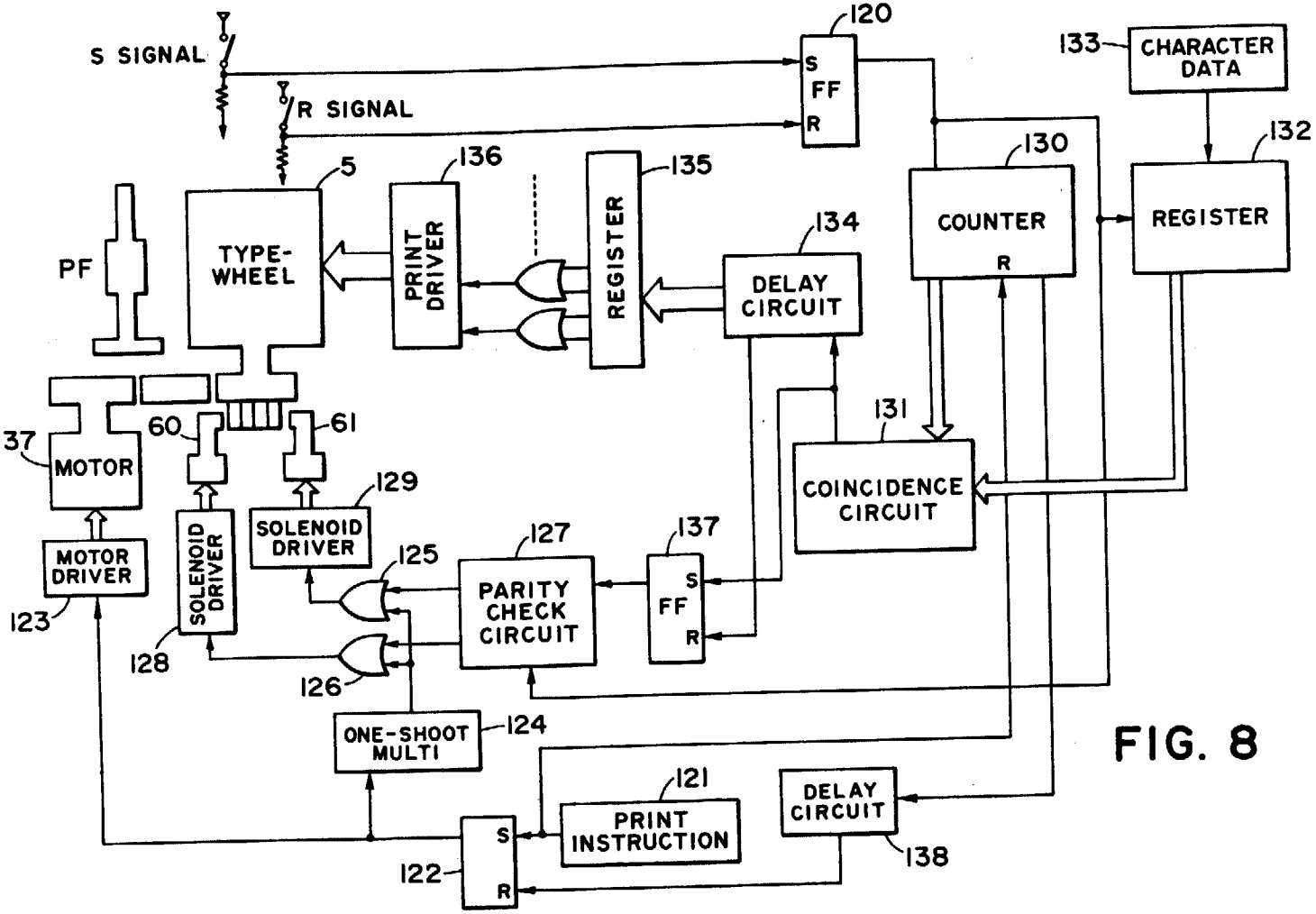
FIG. 8 is a block diagram of the control circuit.

Reference is now made to the block diagram of FIG. 8 to describe the details of the control.

An odd-number timing signal S produced by a code plate having the conductive pattern 53 provided on the side surface of the type wheel 5 is input to the set terminal of a flip-flop 120 and an even-number timing signal R is input to the reset terminal of the flip-flop 120. On the other hand, print instruction 121 is input to the set terminal of a flip-flop 122, and the output of the flip-flop 122 is input to the driver 123 of the motor 37 and also drives a one-shot multivibrator 124 for a predetermined time to cause its output to be input to gate circuits 125 and 126. Thus, the solenoids 60 and 61 are energized by solenoid drivers 128 and 129 for a predetermined time to drive the solenoid levers 63 and 64, thereby releasing the engagement of the stop lever 58 which has so far stopped the type wheel 5. Thus, the type wheel 5 starts rotating. The output signal of a parity check circuit 127 is put out through gate circuits 125 and 126 to solenoid drivers 128 and 129 to drive and control the respective solenoids 60 and 61. In this circuit 127, the check of odd numbers and even numbers is effected by the output signal of the flip-flop 120, and the drive timing of the solenoid drivers 128 and 129 is effected by the set output signal of a flip-flop 137.

The output of the flip-flop 120 is input to a counter 130 and, by counting the rising of the signal thereof, the number of timing signals is counted. This counter 130 is reset by the aforementioned print instruction. The content of the counter 130 is directed to a coincidence circuit 131, where it is compared with the content of a register 132 and the coincidence therebetween is examined. The register 132 has stored therein character data 133 to be printed. The character information stored in the register 132 is alternately and successively read out in such a manner that all the information of odd-number columns is first read out in synchronism with the output (rising and falling) of the flip-flop 120 and then all the information of even-number columns is read out.

For example, where the content of the counter 130 is "1", if information to print 1 is included in the odd-number columns read out from the register 132, it is detected by the coincidence circuit 131 and "1" of a binary signal is caused to be input through a delay circuit 134 to a portion of a serial-input, parallel-output register 135 which corresponds to the column to be printed and "0" is caused to be input to a portion of the register 135 which corresponds to the other column. There are the same number of such parallel-output registers 135 and print drivers 136 as the hammer units 15 and accordingly, in the case of the present example, the number of them is only one half of the number of print columns and they serve both the odd-number column printing and the even-number column printing. The output of the register 135 having stored "1" drives a solenoid corresponding thereto through a print driver 136 and operates the hammer 23 to print a numeral "1" on a predetermined odd-number column of printing paper.

Next, all the information of even-number columns is read out from the register 132 and a solenoid corresponding to the column including the numeral "1" is driven in a similar manner. At this time, the type wheel has moved by one step and the type belts corresponding to even-number columns are all "1", whereby printing can be effected on a column including "1".

The output from the counter 130 is input to the reset terminal of flip-flop 122 through a delay circuit 138 and, after printing of one line has been terminated and after lapse of a predetermined time, it resets the flip-flop 122 to stop the motor 37 from rotating.

As will be appreciated from the foregoing description, the following excellent effects are obtained:

(1) Since an expensive pulse motor or the like is not employed, there can be provided a compact printer in which the control circuit is simple and inexpensive;

(2) Since the means for driving and stopping the type wheel is constructed by the use of inexpensive solenoids and spring clutch, there can be provided a compact printer which is small-sized as a whole and easy to manufacture.

(3) Since the paper feed means is designed to be driven by a mechanism operatively associated with the type wheel through a spring clutch without using the electrical signal from the control circuit, printing paper can be fed after stoppage of the type wheel and thus, there can be provided a printer in which the size of the type wheel has been reduced to a necessary minimum; and (4) Since timing signal is obtained from a code plate integral with the type wheel, the control circuit can be simplified and, where the characters to be printed range over a plurality of columns, printing is effected with a slight shift provided therebetween and thus, stable printing with a small consumption of power can be accomplished.

What we claim is:

1. A compact printer, comprising:

a type wheel having a peripheral surface with a plurality of type rows arranged thereon, each of said type rows being arranged at a first pitch;

motor means for for generating a rotational force to rotate said type wheel;

spring clutch means for selectably transmitting the rotational force of said motor means to said type wheel, said spring clutch means including a ratchet wheel having teeth arranged at a second pitch, wherein said spring clutch means stops transmission of the rotational force of said motor means to said type wheel when rotation of said ratchet wheel is restrained;

a rotationally mounted stop lever having a pawl and being urged by a spring into engagement with the teeth of said ratchet wheel thereby to restrain rotation of said ratchet wheel;

a plurality of solenoid levers having portions in operative relationship with said pawl and which are simultaneously operable to rotate said pawl out of engagement with the teeth of said ratchet wheel thereby enabling rotation of said type wheel and having portions cooperable to stop said ratchet wheel when actuated;

means for maintaining said stop lever out of engagement with said ratchet wheel for a single rotation of said ratchet wheel; and means for selectively actuating one of said solenoid levers at a selected time during said single rotation to momentarily stop said ratation of said type wheel for printing.

2. A compact printer according to claim 1, wherein said maintaining means is a boss formed on a portion of said type wheel.

* * * * *

UNITED STATES PATENT AND TRADEMARK OFFICE

CERTIFICATE OF CORRECTION

PATENT NO. : 4,484,520

DATED : November 27, 1984

INVENTOR(S) : TAKESHI KIMURA, ET AL.

It is certified that error appears in the above-identified patent and that said Letters Patent is hereby corrected as shown below:

Column 1, line 16, Before "effect" delete --thereby--.

Column 4, line 30, After "spring" delete --,--; and line 60, Change "downwardly" to --downward--.

Signed and Sealed this

*Nineteenth* Day of *November 1985*

[SEAL]

*Attest:*

DONALD J. QUIGG

*Attesting Officer*

*Commissioner of Patents and Trademarks*